US007059875B2

(12) United States Patent
Kunimoto

(10) Patent No.: US 7,059,875 B2
(45) Date of Patent: Jun. 13, 2006

(54) GROUND METAL FITTING AND GROUND STRUCTURE FOR JACKS OF ELECTRONIC DEVICES

(75) Inventor: Kazunori Kunimoto, Fukui (JP)

(73) Assignee: Orion Electric Co., Ltd., Fukui (JP)

( * ) Notice: Subject to any disclaimer, the term of this patent is extended or adjusted under 35 U.S.C. 154(b) by 0 days.

(21) Appl. No.: 10/927,282

(22) Filed: Aug. 27, 2004

(65) Prior Publication Data

US 2005/0048814 A1 Mar. 3, 2005

(30) Foreign Application Priority Data

Aug. 28, 2003 (JP) ..... 2003-209237

(51) Int. Cl.
*H01R 4/66* (2006.01)

(52) U.S. Cl. ..... 439/95; 439/607; 439/108

(58) Field of Classification Search ..... 439/95, 439/92, 607–610, 108, 668, 669, 939, 675, 439/676, 567, 76.1
See application file for complete search history.

(56) References Cited

U.S. PATENT DOCUMENTS

| | | | | |
|---|---|---|---|---|
| 3,084,962 | A * | 4/1963 | Feuerbacher | 248/27.3 |
| 4,936,795 | A * | 6/1990 | Kawai et al. | 439/609 |
| 5,281,169 | A * | 1/1994 | Kiat et al. | 439/607 |
| 5,288,248 | A * | 2/1994 | Chen | 439/609 |
| 5,622,523 | A * | 4/1997 | Kan et al. | 439/607 |
| 5,934,940 | A * | 8/1999 | Maranto et al. | 439/607 |
| 6,074,218 | A * | 6/2000 | Wu et al. | 439/63 |
| 6,095,865 | A * | 8/2000 | Wu | 439/607 |
| 6,109,966 | A * | 8/2000 | Chiou | 439/607 |
| 6,183,292 | B1 * | 2/2001 | Chen et al. | 439/541.5 |
| 6,312,267 | B1 * | 11/2001 | Wang | 439/92 |
| 6,343,956 | B1 * | 2/2002 | Stickney | 439/609 |

FOREIGN PATENT DOCUMENTS

| | | |
|---|---|---|
| JP | 6-76885 | 3/1994 |
| JP | 11-121105 | 4/1999 |
| JP | 3095000 | 4/2003 |

* cited by examiner

*Primary Examiner*—Truc T. Nguyen
*Assistant Examiner*—Edwin A. Leon
(74) *Attorney, Agent, or Firm*—Wenderoth, Lind, & Ponack, L.L.P.

(57) ABSTRACT

To provide a ground structure for electronic devices, capable of being fixed to an electronic device and improving a shielding effect thereof even when a cylindrical portion of a jack is fitted in a resin panel, and even when intervals of jacks are small, a ground metal fitting has a front metal plate having at least a jack hole, a recess is formed in at least an upper or lower portion of the jack hole to form an elongated contact member extending from a bottom portion of the recess so as to project to a position on an inner side of an inner circumference of the jack hole so that the contact member is engaged in a bent state with a cylindrical portion of a jack when fitted in the jack hole.

7 Claims, 8 Drawing Sheets

GROUND METAL FITTING AND GROUND STRUCTURE FOR JACKS OF ELECTRONIC DEVICES

BACKGROUND OF THE INVENTION

1. Field of the Invention

The present invention relates to a ground metal fitting and a ground structure for jacks of electronic devices, provided so as to enable a single or plural plug or plugs to be connected to a part of an electronic device through a single or plural hole or holes made in a cabinet thereof.

2. Related Art

As shown in FIGS. 7(*a*) and 7(*b*), a front panel or a rear panel of an electronic device is provided with jacks for connecting the electronic device to an external electronic device. FIG. 7(*a*) shows jacks provided in the front panel, and FIG. 7(*b*) shows jacks provided in the rear panel. When the jacks are provided in the front panel, the jacks include a picture input jack "j", left and right jacks "k", "l" for voice input jacks, and a jack "m" for an S-terminal.

On the other hand, when the jacks are provided in the rear panel, the jacks include an image input jack "j", left and right jacks "k", "l" for voice input jacks, a jack "m" for an S-terminal, and input and output jacks "n", "o" for an antenna. These jacks are grounded so as to prevent the electronic device from encountering troubles of electromagnetic waves. There are various ground structures for these jacks. As a general ground structure, a metal fitting is fitted around an outer circumference of a cylindrical portion of a jack housing, and the jacks are connected to the rear panel via the metal fitting.

As shown in FIGS. 8(*a*) to 8(*c*), a "JACK WITH GROUND HARDWARE" disclosed in JP-A-11-121105 is structured by providing an inner leaf spring "b" and an outer leaf spring "c" on a ground metal fitting "a", holding the ground metal fitting "a" between a jack and a terminal panel "d", bringing the inner leaf spring "b" into contact with a cylindrical portion "e" of the jack, and bringing the outer leaf spring "c" into contact with the terminal panel "d". However, in this ground structure, a clearance "i" between an outer circumference of the cylindrical portion "e" of the jack and an inner circumference of a hole for the ground metal fitting "a" is large, so that a shielding effect of the ground metal fitting is not satisfactorily high. Since inner leaf springs "b", "b" . . . are provided on upper, lower, left and right portions of an inner circumferential surface of the hole mentioned above, the intervals at which jacks are arranged become large, and this necessarily hampers miniaturization of the electronic device.

As shown in FIG. 8(*d*), "ELECTRONIC APPARATUS" disclosed in JP-A-6-76885 is structured by providing a first contact portion "f" and a second contact portion "g" on a ground metal fitting "a", holding the ground metal fitting between a jack and a terminal panel "d", engaging the first contact portion "f" with an inner surface of the terminal panel "d", and engaging the second contact portion "g" with a ground of a cylindrical portion "e" of the jack. Since this ground metal fitting has a three dimensional solid shape having the first contact portion "f" and second contact portion "g", manufacturing of the ground metal fitting is troublesome. It is not easy to form the ground metal fitting to adapt to a plurality of jacks arranged on a panel of an electronic device. Therefore, these ground metal fittings have to be fixed to respective jacks.

As shown in FIG. 8(*e*), "ELECTRIC WAVE LEAKAGE PREVENTING STRUCTURE FOR RCA JACKS AND REAR PANELS" disclosed in JP-U-3095000 is provided on a jack with a ground metal fitting "a" connected to a ground terminal, and on a terminal panel "d" with a claw "h". When the jack is fastened tightly to the terminal panel "d" with a screw, the claw "h" of the terminal panel "d" comes into contact with the ground metal fitting of the jack. In this ground structure, the claw "h" has to be provided on the terminal panel "d".

Owing to the use of such a ground metal fitting, the jack is in contact with the terminal panel and grounded. However, in case the terminal panel (rear panel) is not a conductive panel, e.g. is a resin panel, it cannot be grounded. Although the rear panel of a cabinet of an electronic device is made of metal in many cases, a resin panel is used for the front panel for the sake of design. Therefore, when jacks are provided on the front surface of a cabinet, the above-described ground structure has problems.

Thus, conventional ground structure for electronic devices have such problems as described above.

SUMMARY OF THE INVENTION

The present invention is to solve such problems as referred to above. One object of the present invention is to provide a ground structure for electronic devices, capable of being fixed to an electronic device even when cylindrical portions of jacks are fitted in a resin panel, and even when intervals of the jacks are small; and capable of reducing a clearance between an outer surface of a cylindrical portion of each jack and an inner surface of a hole, in which this cylindrical portion is fitted, of a ground metal fitting, and thereby improving a shielding effect of the ground metal fitting.

A ground metal fitting for jacks of an electronic device according to the present invention comprises a front metal plate having at least a jack hole, a recess formed in at least an upper or lower portion of the jack hole, and an elongated contact member extending from a bottom portion of the recess so as to project to a position on an inner side of an inner circumference of the jack hole so that the contact member is engaged in a bent state with a cylindrical portion of a jack when fitted in the jack hole. A clearance between an inner surface of the jack hole, in which the cylindrical portion of the jack is fitted, and an outer surface of the cylindrical portion of the jack is set small so as to improve a shielding effect of the ground metal fitting.

When a cabinet of an electronic device is formed from metal, the ground structure for jacks of electronic devices according to the present invention comprises a front metal plate having at least a jack hole, recesses formed in upper and lower portions of the jack hole, and elongated contact members extending from bottom portions of the recesses so as to project to positions on an inner side of an inner circumference of the jack hole, with one contact member being engaged in a bent state with a cylindrical portion of a jack when fitted in the jack hole, and the other contact member being engaged with a metal panel of the cabinet.

When a cabinet panel of an electromagnetic machine is formed from a nonconductive material, the ground structure for jacks of electronic devices according to the present invention comprises a front metal plate having at least a jack hole, a recess formed in at least an upper or lower portion of the jack hole, and an elongated contact member extending from a bottom portion of the recess toward a position on an inner side of an inner circumference of the jack hole, with the contact member being engaged in a bent state with a cylindrical portion of a jack when fitted in the jack hole, a bottom plate formed by bending a lower end portion of the front metal plate being engaged with a metal chassis.

BRIEF DESCRIPTION OF THE DRAWINGS

FIGS. 8(*d*) and 8(*e*) are side elevational views of still other related art ground structures.

DETAILED DESCRIPTION OF PREFERRED EMBODIMENTS

Figure 1A:
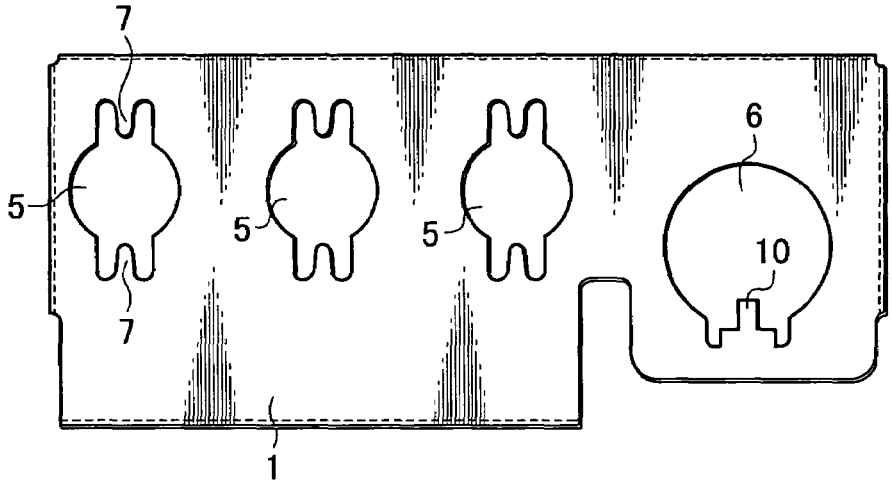
FIG. 1(*a*) is a front view of an embodiment of a ground metal fitting according to the present invention, FIG. 1(*b*) is a plan view of the same, and FIG. 1(*c*) is a left side view of the same.

An embodiment of the present invention will now be described in detail on the basis of what is shown in the drawings.

Figure 1B:
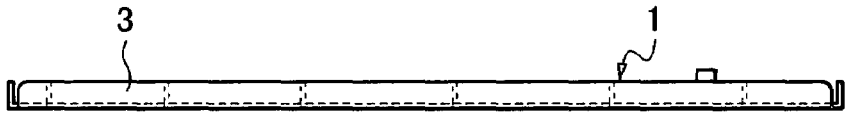
Figure 1C:
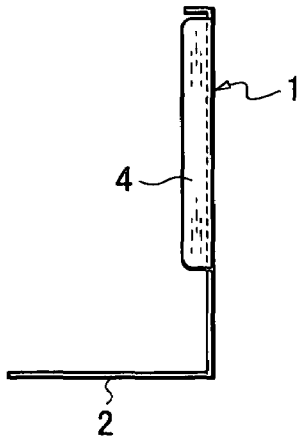

FIGS. 1(*a*) to 1(*c*) show an embodiment of a ground metal fitting according to the present invention, which is made of an L-shaped body having a substantially rectangular front plate 1 and bottom plate 2. The front plate 1 is provided at an upper edge thereof with an upper edge member 3, and at both sides thereof with side edge members 4, 4 formed so as to be bent rearward. The front plate 1 is provided with three jack holes 5 and one jack hole 6 for one jack for an S-terminal. These jack holes are provided with contact members 7, 7 respectively.

Figure 2:
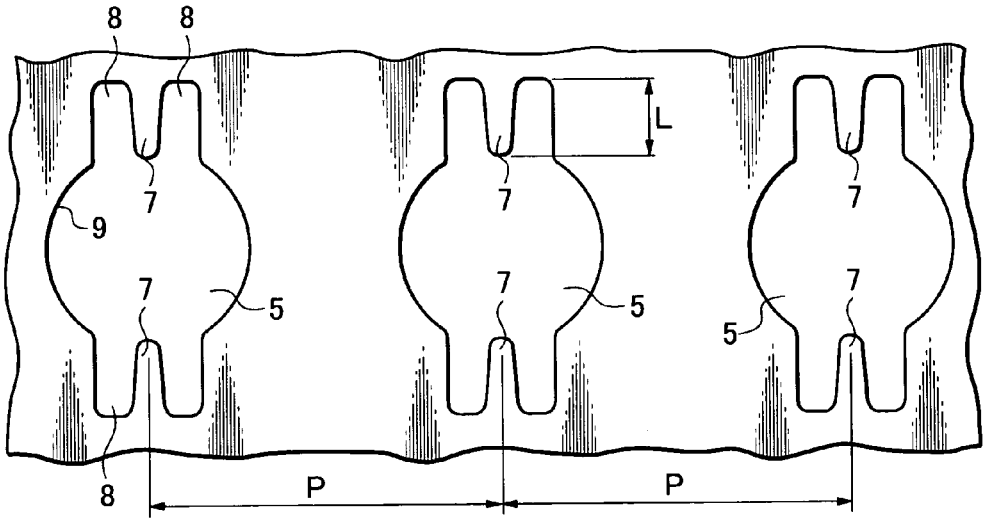
FIG. 2 is an enlarged view of jack holes of the ground metal fitting.

FIG. 2 shows on an enlarged scale a mode of arrangement of the jack holes 5. The jack holes 5 are arranged with a pitch P. Each jack hole 5 is provided in upper and lower portions thereof with two recesses 8, 8 respectively, and contact members 7, 7 extending toward a center of the jack hole 5 are thereby formed in central portions of the recesses. Free ends of projecting contact members 7, 7 extend to a position on a slightly inner side of an inner circumference 9 of the jack hole 5, and can be engaged in a bent state with an outer circumferential surface of a cylindrical portion of a jack when fitted in the jack hole 5.

Each contact member 7 extends from a bottom portion of recess 8, and length L thereof is comparatively large. When the contact member engages the cylindrical portion of the jack fitted in the jack hole 5, the contact member is bent, and an imperfect engagement of the contact member with the jack does not occur. Namely, narrow and long contact member 7 is bent freely in accordance with a thickness of the cylindrical portion of the fitted jack and engages the same. Since the contact members 7, 7 are formed in upper and lower portions of the jack hole 5, the pitch P of the jack holes 5 can be set smaller, and cylindrical portions of jacks can be arranged with a smaller pitch P as a result.

On the other hand, the jack hole 6 for an S-terminal is formed to a larger size than these jack holes 5, and, moreover, a contact member 10 is provided only in a lower side of the jack hole 6 (refer to FIG. 1(*a*)). Unlike the contact members 7, the contact member 10 is not provided with a recess cut downward greatly. The contact member 10 is formed so that this contact member is bent rearward and engaged with a cylindrical portion of a jack easily as will be described later.

Figure 3A:
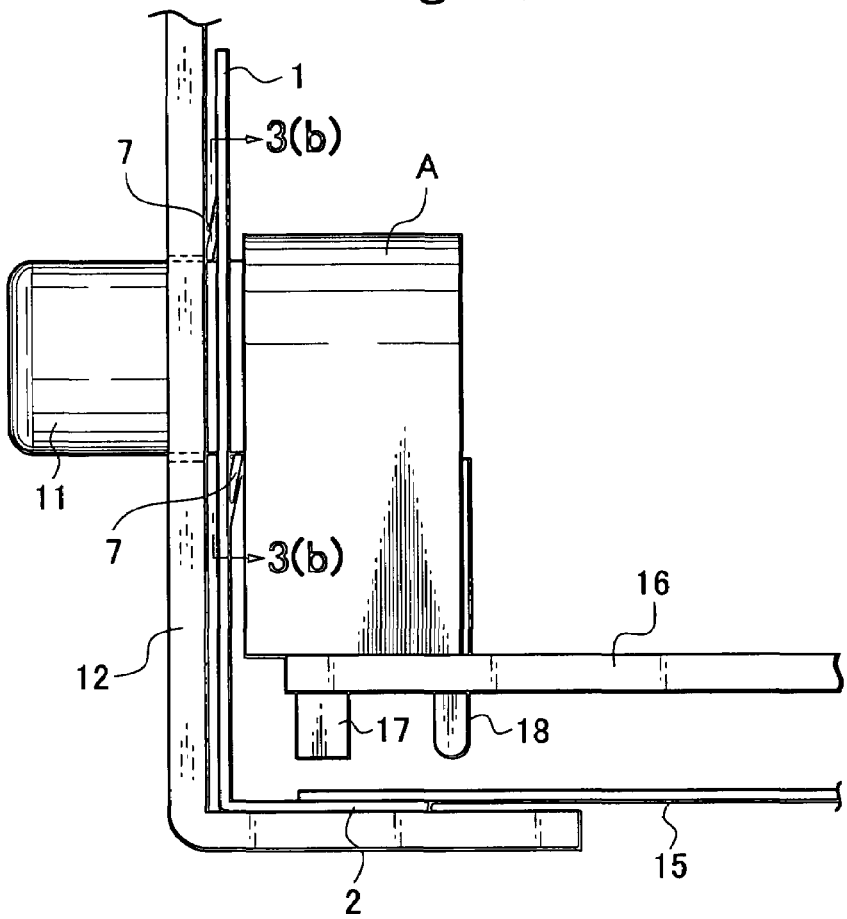
FIG. 3(*a*) is a side elevational view of a ground structure using the ground metal fitting, and FIG. 3(*b*) is a sectional view taken along arrow line 3(*b*)—(3(*b*) in FIG. 3(*a*)
Figure 3B:
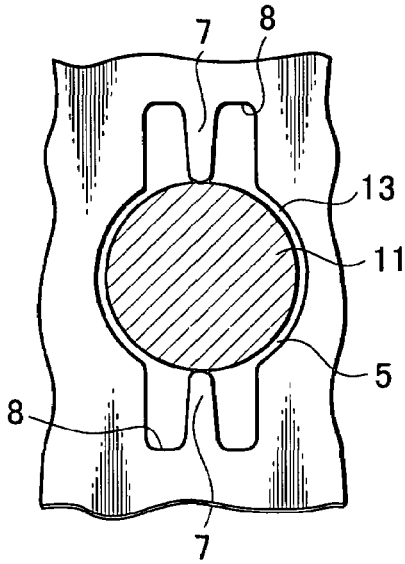

FIGS. 3(*a*) and 3(*b*) show a ground structure in a case where a ground metal fitting 1 is fixed to a front resin panel 12 of an electronic device. This front panel 12 is formed from a resin, and not from a conductive material. Therefore, bottom plate 2 of L-shaped earth metal fitting 1 is held between a metal chassis 15 and a bottom plate of L-shaped panel 12, and contacts the chassis 15. Jack A has a fixing member 17 and a terminal 18, and is fixed to a circuit board 16 by the fixing member 17 and joined to the circuit board by the terminal 18. The front panel 12 is provided therethrough with a hole, from which a cylindrical portion 11 of the jack projects.

In the jack hole 5 of the ground metal fitting 1, the cylindrical portion 11 of the jack A is fitted with the two contact members 7, 7 bent in mutually opposite directions. In order to have the jack A fitted in the jack hole 5 with the contact members 7, 7 bent in the mutually opposite directions, fitting of the cylindrical portion 11 into the jack hole 5 may be performed diagonally. When the cylindrical portion 11 of the jack is inserted into the jack hole 5 parallel with an axis thereof, the two contact members 7, 7 are bent toward the front panel 12, of course, but a problem does not arise because the bottom plate 2 is in contact with the metal chassis 15.

The cylindrical portion 11 of the jack is connected to the chassis 15 via the ground metal fitting and grounded. A clearance 13 between an inner circumference of the jack hole 5 and an outer surface of the cylindrical portion 11 of the jack fitted in the jack hole is small, so that a shielding effect for preventing entry of electromagnetic waves from the clearance 13 is improved. According to the present invention, the recesses 8, 8 extending in a vertical direction are formed in the jack hole 5 so as to reduce the clearance 13, and the elongated contact members 7, 7 extending from bottom portions of the recesses are provided. In order to form the clearance 13 to a large size, it is not necessary to form the recesses and contact members extending from the bottom portions of the recesses. Namely, longer contact members can be provided within a range of the large recesses, and can be engaged in a bent state with the cylindrical portion of the jack fitted in the jack hole. However, a shielding effect is spoiled due to this increased clearance. According to the present invention, a high shielding effect and an excellent engagement of the contact members with the cylindrical portion of the jack fitted in the jack hole can stand together.

Figure 4A:
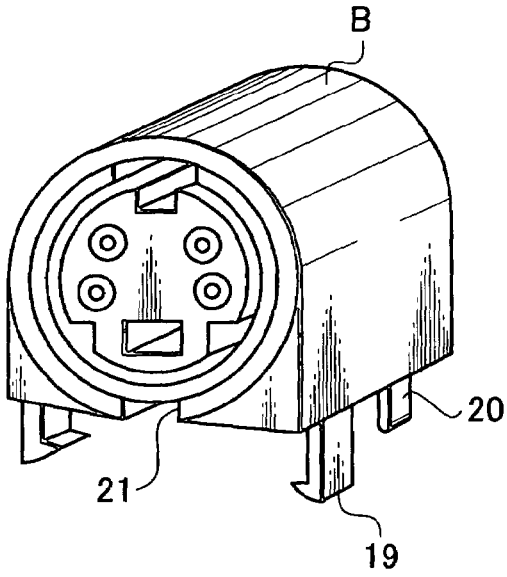
FIG. 4(*a*) is a perspective view showing a jack for an S-terminal, FIG. and 4(*b*) is a side elevational view showing a mode of fixing the jack for the S-terminal.
Figure 4B:
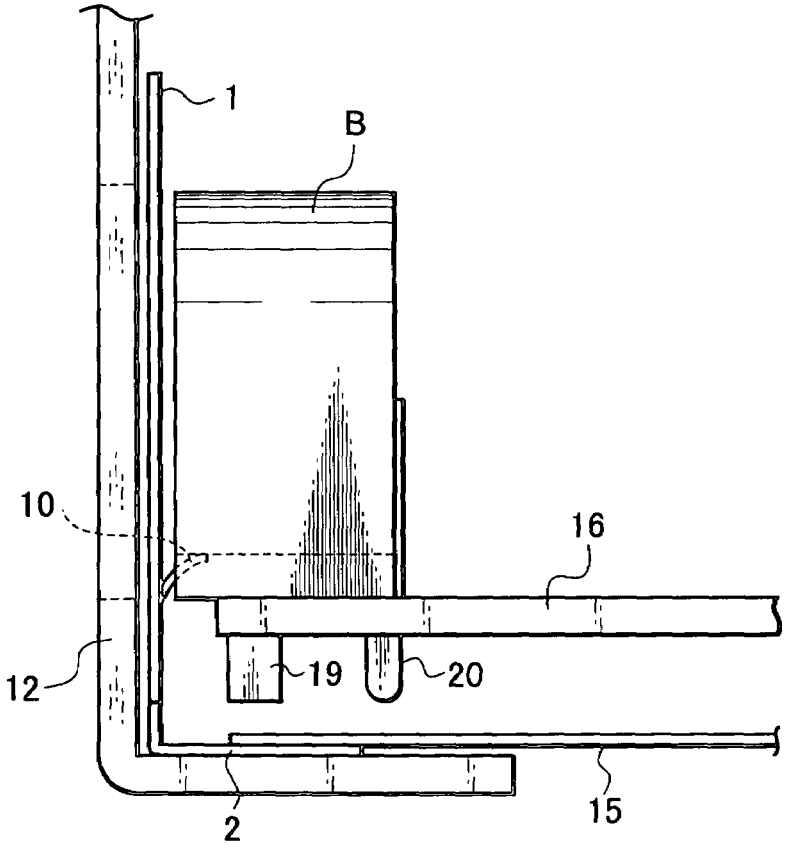

FIG. 4(*b*) shows a ground structure with such a jack B for an S-terminal as shown in FIG. 4(*a*) fixed in a position corresponding to a jack hole 6. The jack B for an S-terminal is also fixed to a circuit board 16 by a fixing member 19 in the same manner as the jack A, and connected to the circuit board by a terminal 20. The jack B for an S-terminal is molded at an outer circumference thereof by a resin layer as shown in FIG. 4(*a*), and cut off at a lower portion thereof to form a recess 21. In a front surface of the jack B for an S-terminal is provided a jack hole 6 for a ground metal fitting 1, and a contact member 10 extends being bent backward diagonally, to engage a cylindrical portion of metal jack B, in the recess 21.

Figure 5A:
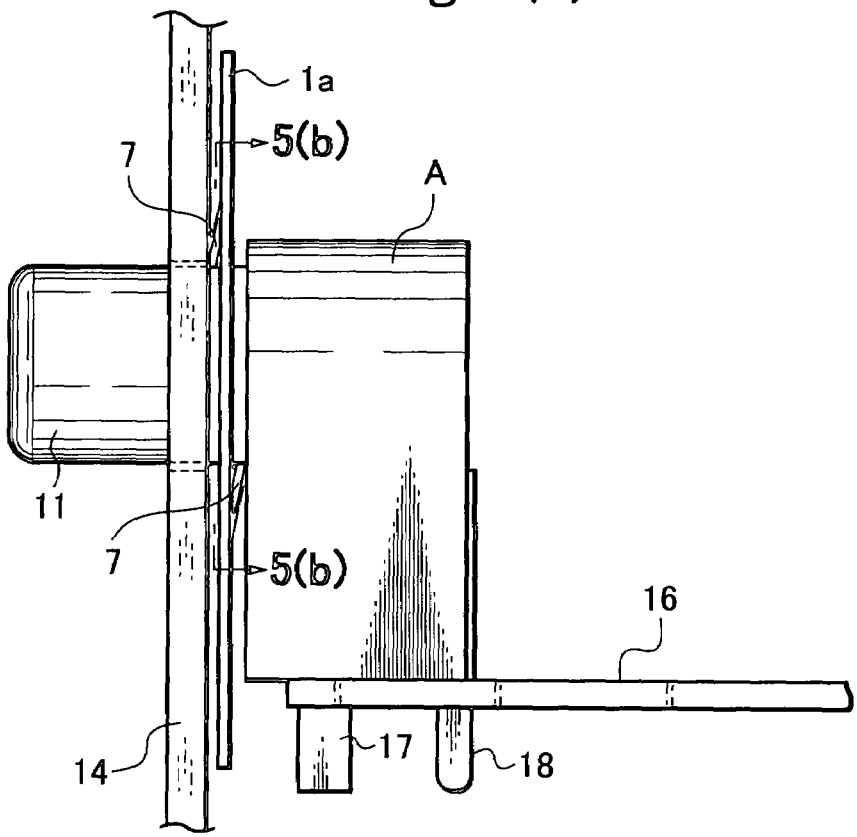
FIG. 5(*a*) is a side elevational view showing another embodiment of the ground structure, and FIG. 5(*b*) is a sectional view taken along arrow-carrying line 5(*b*)—5(*b*) in FIG. 5(*a*)
Figure 5B:
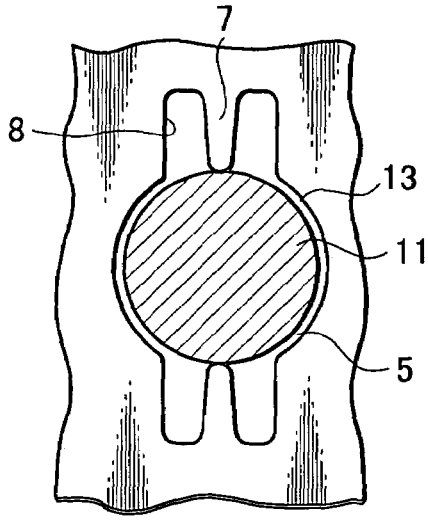

FIGS. 5(*a*) and 5(*b*) show another mode of ground structure with a ground metal fitting 1*a* fixed to a rear metal panel 14. The ground metal fitting 1*a* is fixed to the rear metal panel 14, and a cylindrical portion 11 of a jack A is fitted in a jack hole 5. The ground metal fitting 1*a* is not provided with such a bottom plate 2 as shown in FIG. 1. The ground metal fitting 1*a* fixed to the cylindrical portion 11 of the jack A is held between the jack A and rear panel 14. The rear panel 14 is provided with a through hole, from which the cylindrical portion 11 of the jack projects.

Contact members 7, 7 formed on the ground metal fitting 1*a* engage the cylindrical portion 11 of the jack. Elongated contact members 7, 7 can be deformed by engaging the cylindrical portion 11 of the jack. Out of two, i.e. upper and lower contact members 7, 7, one contact member 7 is bent toward the side of the jack A, and the other contact member 7 toward the side of the rear panel 14. The two contact members 7, 7 engage the cylindrical portion 11 of the jack, and the contact member 7 bent toward the side of the rear panel 14 engages the rear panel 14 as well. Since the rear panel 14 is made of a metal, the cylindrical portion 11 of the jack is joined to the rear panel 12 via the ground metal fitting 1*a* and grounded.

In order to bend the two contact members 7, 7 in opposite directions relative to each other, the cylindrical portion 11 of the jack may be fitted diagonally as mentioned above into jack hole 5 of ground metal fitting A. The cylindrical portion 11 of the jack may also be inserted into the jack hole 5 in parallel with a central axis thereof to bend the two contact members 7, 7 toward the side of the rear panel 14. A reason for this is that free end portions of the two contact members 7, 7 are engaged with the cylindrical portion 11 of the jack and the rear panel 14.

Figure 6A:
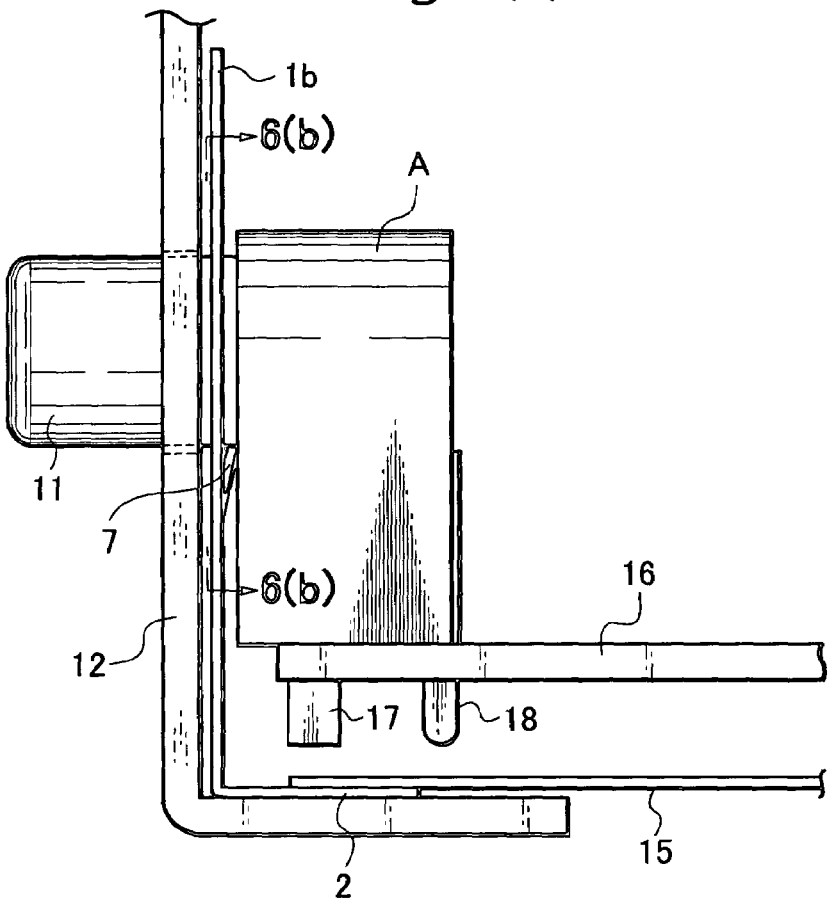
FIG. 6(*a*) is a side elevational view showing still another embodiment of the ground structure, and FIG. 6(*b*) is a sectional view taken along arrow-carrying line 6(*b*)—6(*b*) in FIG. 6(*a*)
Figure 6B:
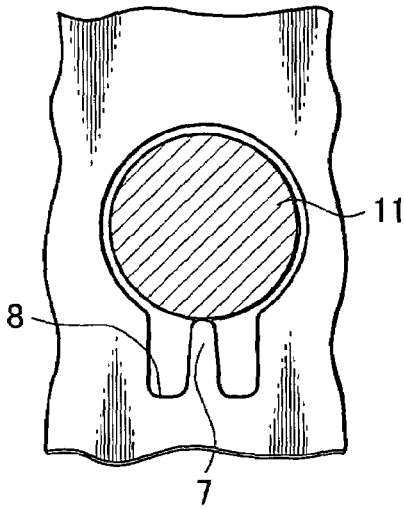
Figure 7A:
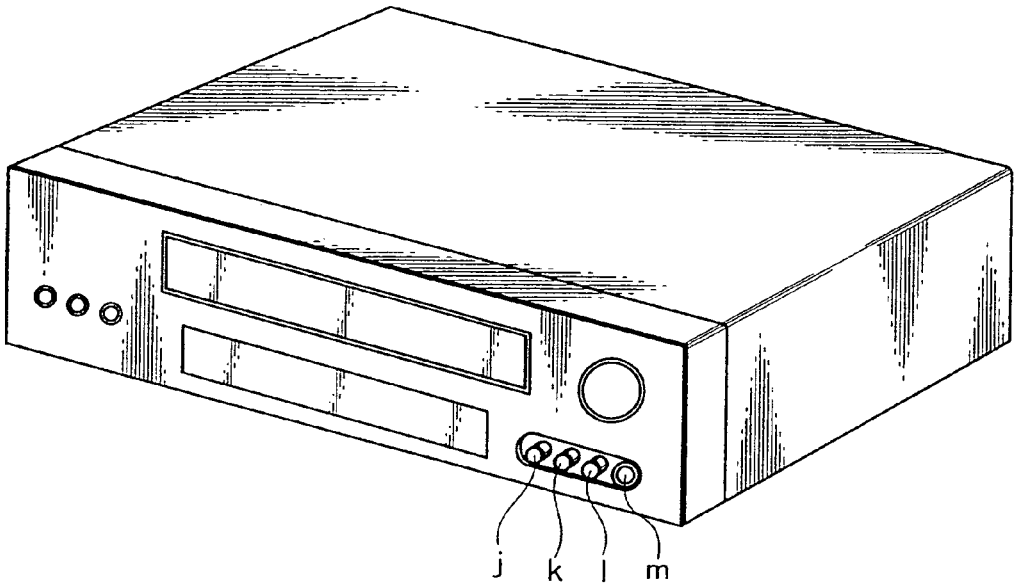
Fig. 7(a) PRIOR ART
FIG. 7(*a*) is a perspective view showing an electronic device provided with jacks in a front panel thereof, and FIG. 7(*b*) is a perspective view showing an electronic device provided with jacks in a rear panel thereof.
Figure 7B:
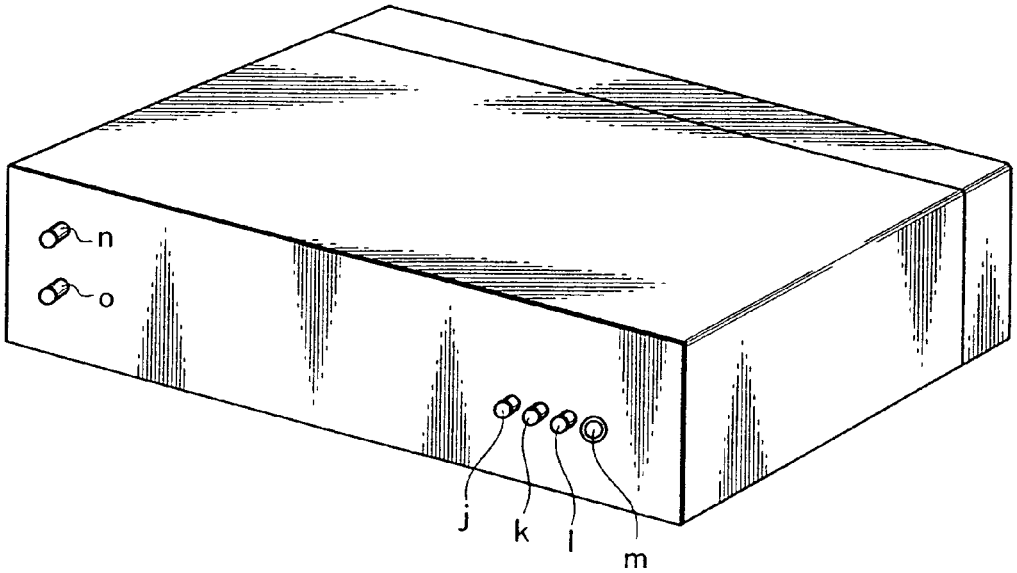
Fig. 7(b) PRIOR ART
Figure 8A:
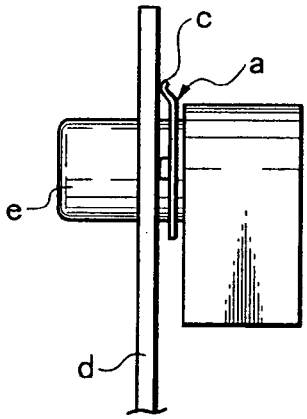
Fig. 8(a) PRIOR ART
FIG. 8(*a*) is a side elevational view showing a conventional ground structure, and FIGS. 8(*b*) and 8(*c*) are a front view and a side elevational view thereof.
Figure 8B:
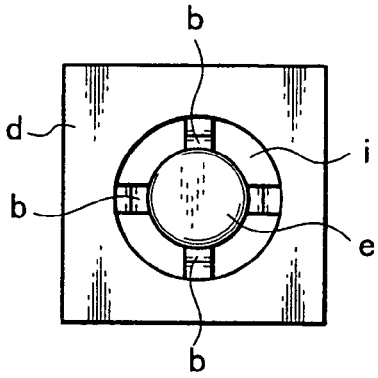
Fig. 8(b) PRIOR ART
Figure 8C:
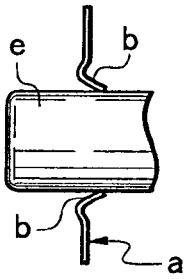
Fig. 8(c) PRIOR ART
Figure 8D:
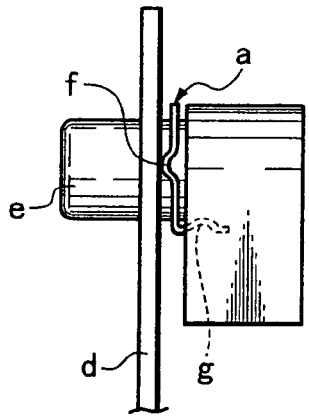
Fig. 8(d) PRIOR ART
Figure 8E:
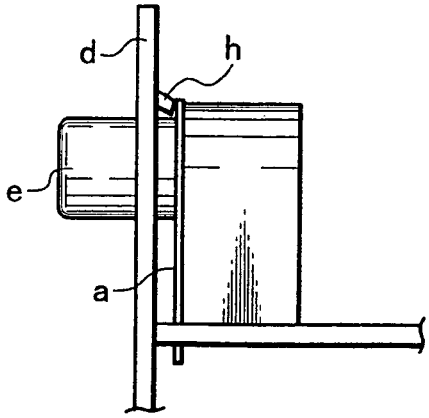
Fig. 8(e) PRIOR ART

FIGS. 6(*a*) and 6(*b*) show still another mode of the ground structure with a ground metal fitting 1*b* fixed to a front resin panel 12. A difference between this embodiment and the embodiment of FIG. 3(*a*) resides only in that a contact member 7 of the former is provided in a lower portion alone of a jack hole 5 of the earth metal fitting 1*b*. Namely, a recess 8 is formed only in a lower portion of the jack hole 5, and the contact member 7 is extended from a bottom portion of this recess, with a free end portion of the contact member 7 being engaged in a bent state with a cylindrical portion 11 of a jack A. Even when a rear panel is made of a resin, the same ground structure can be applied, of course.

Although the ground metal fitting shown in FIG. 1 is formed for a four-jack-carrying electronic device, the number of the jacks is not specially limited. The ground metal fitting can also be formed for one-jack-carrying electronic device. The ground metal fitting according to the present invention is provided as described above with recesses in upper and/or lower portions of a jack hole formed in a front plate, and contact members are extended from bottom portions of the recesses. The present invention can attain the following effects.

In the ground metal fitting according to the present invention, the contact members are extended from the bottom portions of the recesses formed by cutting a jack hole upward and/or downward. Therefore, a length of the contact members is large, and the contact members can be engaged in a bent state with a cylindrical portion of a jack, so that an imperfect engagement of the contact members with the jack does not occur. Since the recesses and contact members are provided so as to extend vertically, intervals of the jack holes can be set smaller. This enables intervals of jacks fixed to a circuit board to be reduced, and an electronic device to be miniaturized.

The ground metal fitting can be fixed even when a cylindrical portion of a jack is fitted in a resin panel. It is also possible to reduce a clearance between an outer circumference of the cylindrical portion of the jack and an inner circumference of a hole, in which the cylindrical portion is fitted, of the ground metal fitting, so as to prevent entry of external electromagnetic waves into the electronic device, and thereby improve a shielding effect

What is claimed is:

1. A ground structure to be arranged substantially between one of a front, rear or side surface of a cabinet of an electronic device and a jack provided on the one of the front, rear or side surface for grounding the jack so as to connect the jack to another device, comprising:

a plate having a first surface and a second surface;

a jack hole extending through said first and second surfaces;

a first recess in said plate at a first portion of said jack hole and extending from a periphery of said jack hole along said first and second surfaces;

a second recess in said plate at a second portion of said jack hole and extending from said periphery of said jack hole along said first and second surfaces;

a first elongated contact member extending from an end portion of said first recess so as to project to a position on an inner side of said periphery of said jack hole such that said first elongated contact member is engaged in a bent state with a peripheral portion of the jack when the jack is fitted in said jack hole; and a second elongated contact member extending from an end portion of said second recess, said second elongated contact member to be engaged with a metal panel of the cabinet.

2. The ground structure according to claim 1, wherein said plate, said first elongated contact member and said second elongated contact member are each metallic.

3. The ground structure according to claim 2, wherein said first surface and said second surface are each planar.

4. The ground structure according to claim 3, wherein said plate is substantially rectangular in shape.

5. The ground structure according to claim 4, wherein said first recess is at one of an upper portion and a lower portion of said jack hole, and said second recess is at the other of said upper portion and lower portion of said jack hole, when said plate stands vertically.

6. The ground structure according to claim 5, wherein said jack hole is circular such that said first elongated contact member is engaged in a bent state with a cylindrical portion of the jack when the jack is fitted in said jack hole.

7. The ground structure according to claim 6, wherein said second elongated contact member extends from said end portion of said second recess so as to project to a position on the inner side of the periphery of said jack hole.

* * * * *